US010322864B2

(12) United States Patent
Wada et al.

(10) Patent No.: US 10,322,864 B2
(45) Date of Patent: Jun. 18, 2019

(54) SYNTHETIC RESIN BOTTLE

(71) Applicants: Takuya Wada, Tokyo (JP); Tadayori Nakayama, Tokyo (JP)

(72) Inventors: Takuya Wada, Tokyo (JP); Tadayori Nakayama, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 71 days.

(21) Appl. No.: 15/435,811

(22) Filed: Feb. 17, 2017

(65) Prior Publication Data

US 2017/0283152 A1 Oct. 5, 2017

(30) Foreign Application Priority Data

Mar. 30, 2016 (JP) ..... 2016-069192

(51) Int. Cl.
*B65D 1/02* (2006.01)
*B65D 79/00* (2006.01)

(52) U.S. Cl.
CPC ..... *B65D 79/005* (2013.01); *B65D 1/0246* (2013.01); *B65D 1/0261* (2013.01); *B65D 1/0276* (2013.01); *B65D 2501/0036* (2013.01)

(58) Field of Classification Search
CPC .... B65D 79/005; B65D 1/0223; B65D 1/023; B65D 2501/0036
See application file for complete search history.

(56) References Cited

U.S. PATENT DOCUMENTS

| | | | | |
|---|---|---|---|---|
| 6,726,044 | B1 | 4/2004 | Deubel et al. | |
| 2003/0075521 | A1 | 4/2003 | Miura | |
| 2004/0232103 | A1* | 11/2004 | Lisch | B65D 79/005 215/374 |
| 2006/0113274 | A1 | 6/2006 | Keller et al. | |
| 2015/0136726 | A1 | 5/2015 | Nagaoka et al. | |

FOREIGN PATENT DOCUMENTS

| | | | |
|---|---|---|---|
| DE | 10 2009 038 608 | A1 | 3/2011 |
| WO | 2010/061758 | A1 | 6/2010 |

OTHER PUBLICATIONS

Aug. 28, 2017 Extended Search Report issued in European Patent Application No. 17157616.8.

* cited by examiner

*Primary Examiner* — Andrew T Kirsch
(74) *Attorney, Agent, or Firm* — Oliff PLC

(57) ABSTRACT

A synthetic resin bottle prevents a trunk from undergoing unsightly deformation in response to reduced pressure inside the bottle and also increases flexibility in terms of container design and secures a label attachment area sufficiently. A synthetic resin bottle includes a mouth, a trunk, and a bottom, with a reduced pressure absorbing region configured to be displaced toward the inside of the bottle in response to reduced pressure inside the bottle. The trunk includes a cylindrical-shaped straight region, which has a length of not less than 100 mm in an axis direction extending along a center axis of the trunk and in which no irregularities are provided. The straight region has a weight of not less than 11 times a weight of the reduced pressure absorbing region.

3 Claims, 3 Drawing Sheets

SYNTHETIC RESIN BOTTLE

TECHNICAL FIELD

This disclosure relates to a synthetic resin bottle, especially, to a synthetic resin bottle that includes a bottom configured, when an inside of the synthetic resin bottle is placed in a reduced pressure state, to be displaced toward the inside to absorb the reduced pressure.

BACKGROUND

To fill a content medium such as wine into a synthetic resin bottle, a so-called hot filling method, which involves filling of the content medium into a bottle at a temperature of, for example, from 50 to 70° C., followed immediately by capping to seal the bottle, may be used.

Since the bottle is sealed and subsequently cooled in the high filling method, the inside of the bottle is placed under a reduced pressure state. To absorb the reduced pressure, the bottle is known to be sometimes provided in the bottom thereof with a region (reduced pressure absorbing region) that is displaceable toward the inside of the bottle in response to the reduced pressure. (Refer to, for example, Patent Literature 1.)

CITATION LIST

Patent Literature

PTL 1: WO2010061758A1

SUMMARY

In such a (bottle) container, in an attempt to prevent the trunk from being deformed inappropriately when the inside of the bottle is under reduced pressure, rigidity of the trunk may be increased by providing irregularities such as ribs in the trunk or providing the reduced pressure absorbing regions (reduced pressure absorbing panels) in the trunk. However, providing the irregularities or the reduced pressure absorbing panels in the trunk poses the problems of decreased flexibility in terms of container design and difficulty in securing a surface area over which a label is attached.

Accordingly, the present disclosure is to provide a synthetic resin bottle provided in the bottom thereof with the reduced pressure absorbing region that prevents the trunk from undergoing unsightly deformation in response to the reduced pressure inside the bottle and that also increases flexibility in terms of container design and secures the label attachment area sufficiently.

The present disclosure has been conceived to solve the above problems, and one of aspects of the present disclosure resides in a synthetic resin bottle including: a mouth through which a content medium is dispensed; a trunk contiguous with and below the mouth; and a bottom that is contiguous with and below the trunk and that is provided with a reduced pressure absorbing region configured to be displaced toward an inside of the bottle in response to reduced pressure inside the bottle. The trunk includes a cylindrical-shaped straight region which has a length of not less than 100 mm in an axis direction extending along a center axis of the trunk and in which no irregularities are provided, and he straight region has a weight of not less than 11 times a weight of the reduced pressure absorbing region.

In the synthetic resin bottle, the weight of the straight region is preferably not less than 12 times and not more than 15 times the weight of the reduced pressure absorbing region.

In the synthetic resin bottle, the synthetic resin bottle includes content medium container space having a capacity of preferably not less than 500 ml and not more than 800 ml and more preferably not less than 700 ml and not more than 800 ml.

The present disclosure provides a synthetic resin bottle provided in the bottom thereof with the reduced pressure absorbing region that prevents the trunk from undergoing unsightly deformation in response to the reduced pressure inside the bottle and that also increases flexibility in terms of container design and secures the label attachment area sufficiently.

DETAILED DESCRIPTION

Figure 1:
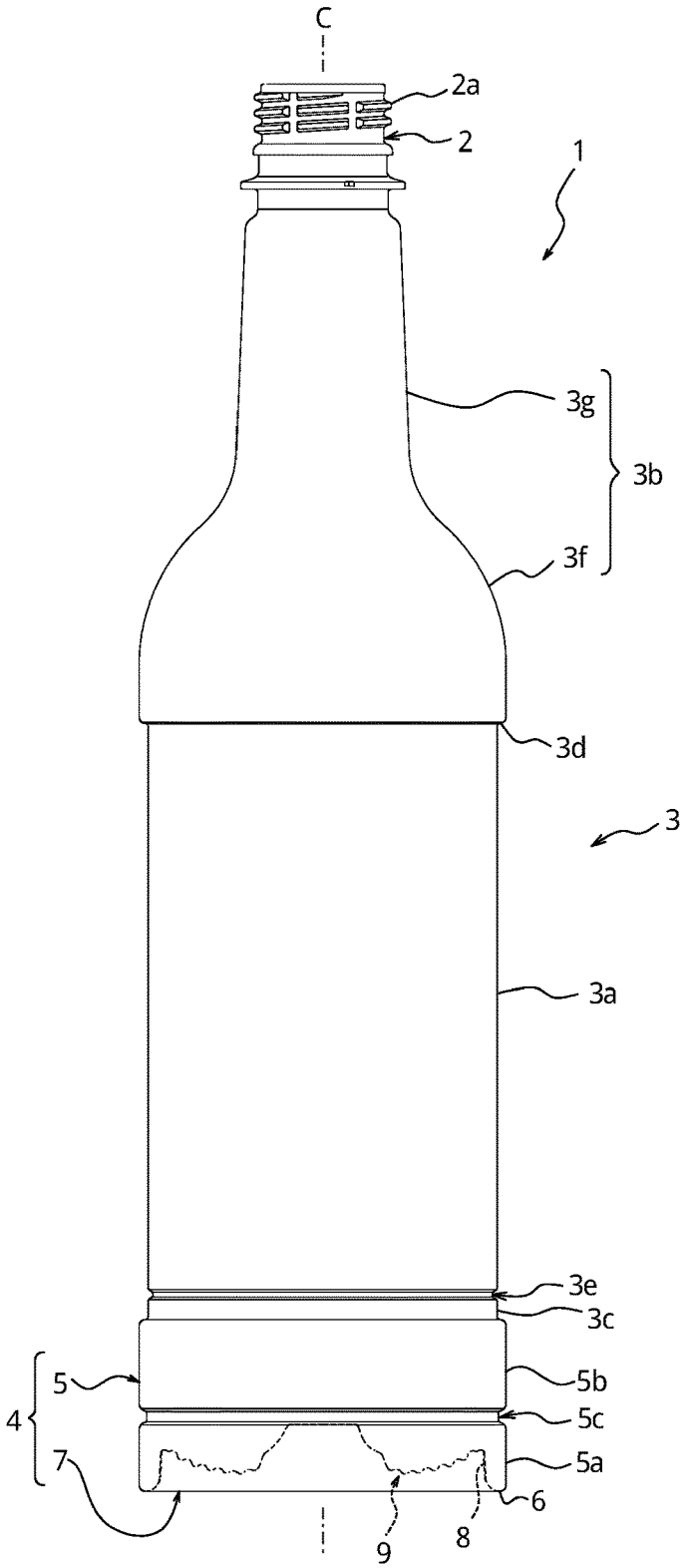
FIG. 1 is a side view illustrating a synthetic resin bottle according to one of embodiments of the present disclosure.

The present disclosure will be described in more detail below with reference to the drawings. FIG. 1 is a side view of a synthetic resin bottle (hereinafter, simply called "bottle 1") according to one of embodiments of the present disclosure.

The bottle 1 includes a cylindrical-shaped mouth 2, through which a content medium is dispensed, a trunk 3, which is contiguous with and below the mouth 2 and which has a circular section, and a bottom 4, which is contiguous with and below the trunk 3. The mouth 2, the trunk 3, and the bottom 4 are connected integrally. The bottle 1 also includes, inside thereof, container space in which the content medium may be contained. The content medium is not limited to any medium and may be wine. The content medium may be any medium which may be hot filled, sealed, and subsequently cooled to not more than room temperature.

The mouth 2 is provided, on an outer circumferential surface thereof, with a screw portion 2*a*, which is configured to hold a cap. Additionally, the dispensing cap may also be held by an undercut portion instead of the screw portion 2*a*.

The trunk 3 has a cylindrical-shaped straight region 3*a*, in which no irregularities are provided. The straight region 3*a* has a length of not less than 100 mm in an axis direction (upper-lower direction) extending along a center axis C. In the straight region 3*a*, a label or the like may be attached, or other decorations such as prints and paints may be applied. The trunk 3 also has an upper region 3*b*, which is contiguous with and above the straight region 3*a* and which extends to the mouth 2 while being reduced in diameter upward, and a lower region 3*c*, which is contiguous with and below the straight region 3*a* and which extends to the bottom 4. In a border portion between the straight region 3*a* and the upper region 3*b*, an annular-shaped stepped portion 3*d* is formed, and in a border portion between the straight region 3*a* and the lower region 3*c*, the first annular-shaped groove 3*e* is formed. The upper region 3*b* includes a shoulder 3*f*, which is located on the side of the straight region 3*a,* and a small-diameter neck 3*g,* which is contiguous with the shoulder 3*f.*

Figure 2:
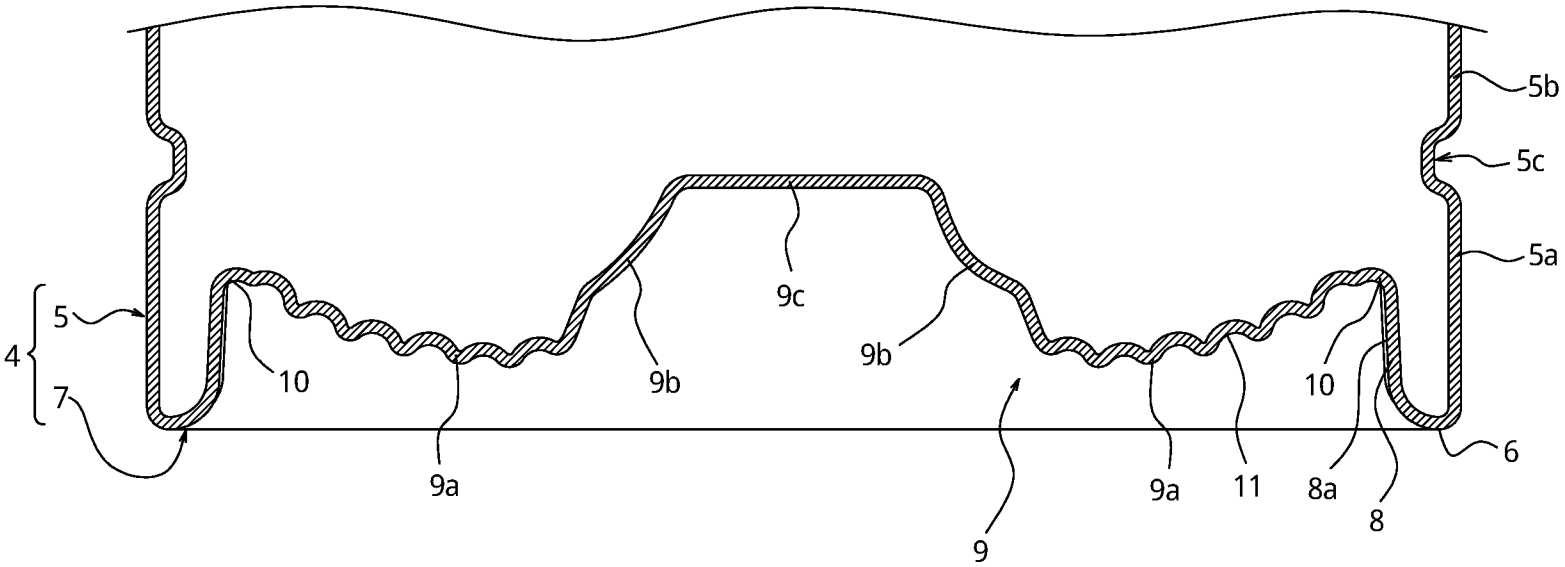
FIG. 2 is an enlarged sectional view of a part of a synthetic resin bottle illustrated in FIG. 1.
Figure 3:
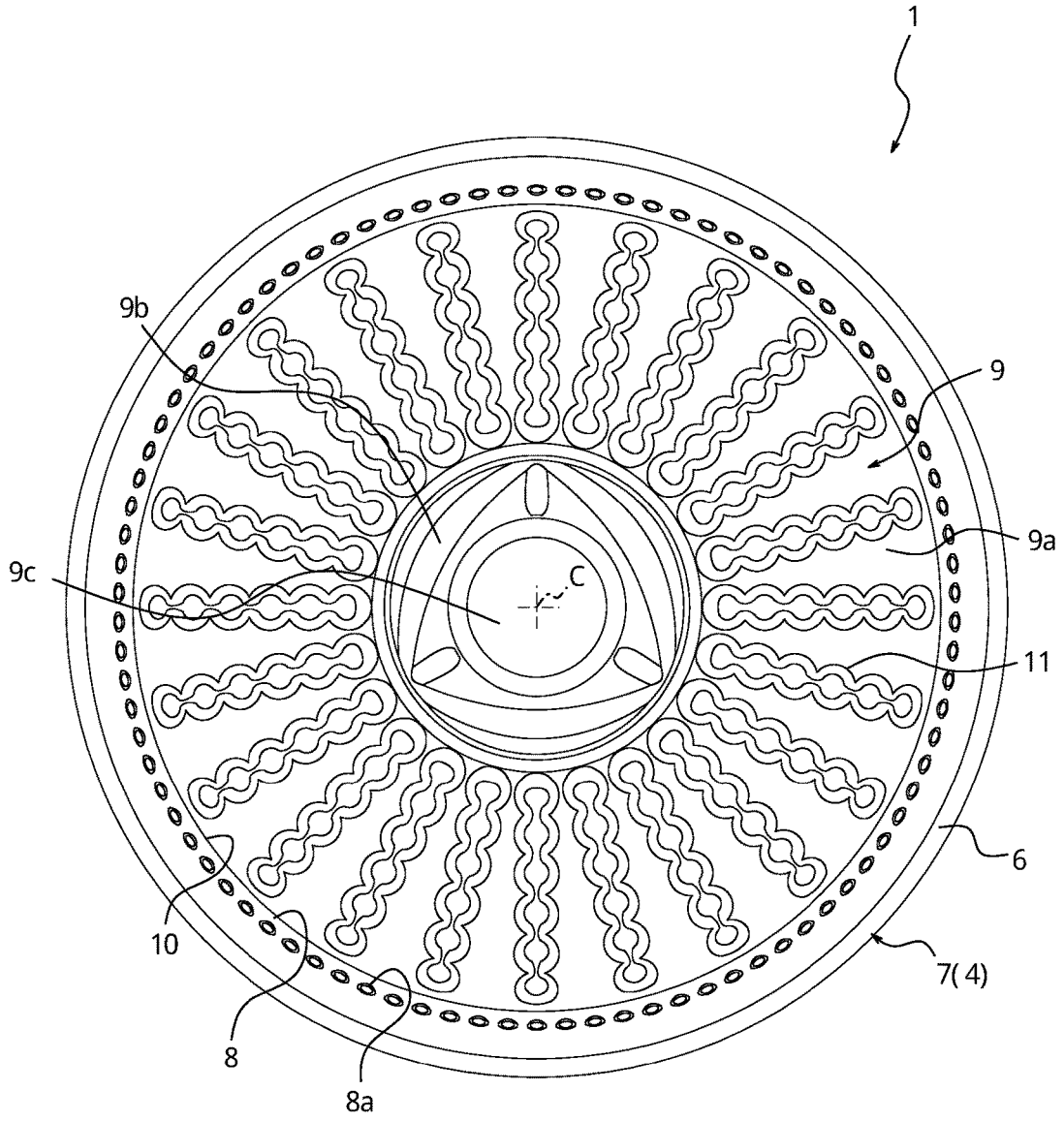
FIG. 3 is a bottom view of a synthetic resin bottle illustrated in FIG. 1.

As illustrated in FIGS. 2 and 3, the bottom 4 includes a heel portion 5, which has an upper end opening connected to a lower end opening of the trunk 3, and a bottom wall portion 7, which closes a lower end opening of the heel portion 5 and which has an outer circumferential edge portion serving as a ground contacting portion 6.

The heel portion 5 includes a lower heel portion 5*a,* which is contiguous with the outer side of the ground contacting portion 6 in the radial direction, and an upper heel portion 5*b,* which is contiguous with the trunk 3 from below. In the present example, the heel portion 5 has an outer diameter that is slightly greater than an outer diameter of the straight region 3*a* of the trunk 3. In a connecting portion between the lower heel portion 5*a* and the upper heel portion 5*b,* the second annular-shaped groove 5*c* is formed.

The bottom wall portion 7 includes a tubular-shaped rising wall 8, which is contiguous with the inner side of the ground contacting portion 6 in the radial direction and which extends upward, and a reduced pressure absorbing region 9, which is contiguous with an upper end portion of the rising wall 8 and which is provided on the inner side of the rising wall 8 in the radial direction. The rising wall 8 is provided with a plurality of protruding portions 8*a,* which is arranged at an interval in the circumferential direction.

The reduced pressure absorbing region 9 includes an annular-shaped outer side wall 9*a,* which is contiguous with the rising wall 8 via an annular-shaped curved surface portion 10 as a pivot point of rotating displacement and which is convex downward, an inner side wall 9*b,* which is contiguous with the inner side of the outer side wall 9*a* in the radial direction and which extends upward, and a ceiling wall 9*c*, which is located on an upper end of the inner side wall 9*b*. The outer side wall 9*a* is provided with bottom rib portions 11, in which a plurality of concave portions, each depressed upward in a curved surface shape, is arranged intermittently along the radial direction. The bottom rib portions 11 are arranged radiately about the center axis C. The reduced pressure absorbing region 9 is displaced toward the inside of the bottle about the curved surface portion 10 in response to reduced pressure inside the bottle. In detail, with the curved surface portion 10 as the pivot point, the outer side wall 9*a* is swingably displaced upward (toward the inside of the bottle), and in conjunction with the outer side wall 9*a,* the inner side wall 9*b* and the ceiling wall 9*c* are also displaced upward. Additionally, the shape of the reduced pressure absorbing region 9 is not limited to the aforementioned example.

Herein, the straight region 3*a* of the trunk 3 has a weight of not less than 11 times a weight of the reduced pressure absorbing region 9. With the above configuration, by hot filling the content medium into the bottle 1 and capping the mouth 2 to seal the bottle 1 and subsequently, cooling the content medium to not more than room temperature, the reduced pressure absorbing region 9 of the bottom 4, before the trunk 3, is displaced toward the inside of the bottle when the inside of the bottle 1 is placed under the reduced pressure state. This prevents unsightly deformation of the trunk 3. Additionally, in the present example, when the reduced pressure absorbing region 9 is displaced toward the inside of the bottle completely, the capacity of the inside of the bottle is reduced by not less than 25 ml.

Furthermore, from the perspective of achieving the reduced pressure absorption effect of the bottom 4 more reliably while preventing unsightly deformation of the trunk 3, the weight of the straight region 3*a* is preferably not less than 12 times the weight of the reduced pressure absorbing region 9. Moreover, from the perspective of preventing an excessive increase in weight of the trunk 3 and lack in rigidity of the reduced pressure absorbing region 9, the weight of the straight region 3*a* is preferably not more than 15 times the weight of the reduced pressure absorbing region 9.

In the bottle 1 of the present embodiment, since the length in the axis direction of the straight region 3*a,* in which no irregularities are provided, is not less than 100 mm, flexibility in terms of container design is increased, and the label attachment area is secured sufficiently.

The bottle 1 includes inner space (content medium container space), whose capacity is preferably, but not particularly limited to, not less than 500 ml and not more than 800 ml. The capacity is more preferably not less than 700 ml and not more than 800 ml. The above configuration further ensures that the effect of preventing unsightly deformation of the trunk 3 is provided while content medium container space is secured sufficiently.

EXAMPLES

The following describes Examples of the present disclosure. However, the present disclosure is not limited to the following Examples.

As example bottles, Examples 1 and 2, which had a shape illustrated in FIG. 1 and in which a ratio of the weight of the straight region 3*a* included in the trunk 3 to the weight of the reduced pressure absorbing region 9 included in the bottom 4 was not less than 11, were prepared. As comparative example bottles to Examples 1 and 2, Comparative Examples 1 and 2, in which the ratio was less than 11, were prepared. Table 1 shows, for each of Examples 1 and 2 and Comparative Examples 1 and 2, the weight (g) of the reduced pressure absorbing region, the weight (g) of the straight region, and the aforementioned ratio (the weight of the straight region/the weight of the reduced pressure absorbing region). Additionally, the bottles of Examples 1 and 2 and Comparative Examples 1 and 2 each have an overall bottle weight of 48 g, a capacity of the inside of the bottle of 720 ml, a length in the axis direction of the straight region of 113.5 mm, an outer diameter of the straight region of 70 mm, an overall height of 282 mm, and an outer diameter of the heel portion of 73.5 mm.

TABLE 1

| | Example 1 | Example 2 | Comparative Example 1 | Comparative Example 2 |
|---|---|---|---|---|
| Weight (g) of reduced pressure absorbing region | 1.6 | 1.9 | 2.2 | 2.3 |
| Weight (g) of straight region | 23.6 | 22.7 | 22.8 | 22.3 |
| Weight of straight region/ weight of reduced pressure absorbing region | 14.6 | 11.9 | 10.5 | 9.5 |
| Absorption capacity | OK | OK | NG | NG |

The content medium (wine) at from 50 to 70° C. was filled into the bottle of each of Examples and Comparative Examples, the mouth was capped for sealing, and subsequently, the content medium was cooled to room temperature. At this stage, the state of deformation of the bottle was examined. As for "absorption capacity" shown in Table 1, it is determined as "OK" in cases where, when the inside of the bottle was placed under reduced pressure, the capacity of the inside of the bottle was reduced by 25 ml due to the reduced pressure absorbing region being displaced toward the inside of the bottle. On the other hand, it was determined as "NG" in cases where, when the inside of the bottle was placed under reduced pressure, the capacity was reduced by less than 25 ml due to the reduced pressure absorbing region failing to be displaced toward the inside of the bottle sufficiently or the trunk was displaced inappropriately before the reduced pressure absorbing region was displaced.

As shown in Table 1, Examples 1 and 2, in each of which the ratio of the weight of the straight region to the weight of the reduced pressure absorbing region was not less than 11, exhibited less inappropriate deformation of the trunk and also exhibited desired absorption capacities due to displacement of the reduced pressure absorbing regions, compared with Comparative Examples 1 and 2, in each of which the ratio was less than 11.

The invention claimed is:

1. A synthetic resin bottle comprising:

a mouth through which a content medium is dispensed;

a trunk contiguous with and below the mouth, the trunk including a cylindrical-shaped straight region having a length of not less than 100 mm in an axial direction extending along a center axis of the trunk and in which no irregularities are provided; and a bottom contiguous with and below the trunk, the bottom being provided with a reduced pressure absorbing region configured to be displaced toward an inside of the bottle in response to reduced pressure inside the bottle, wherein:

the cylindrical-shaped straight region has a weight of not less than 11 times a weight of the reduced pressure absorbing region, the trunk includes (i) an upper region located above the cylindrical-shaped straight region and extending to the mouth, (ii) an annular-shaped stepped portion formed between the cylindrical-shaped straight region and the upper region, the upper region continuously reducing in diameter from the annular-shaped stepped portion to the mouth, and (iii) a lower region located below the cylindrical-shaped straight region and extending to the bottom, and a first annular-shaped groove is formed between the cylindrical-shaped straight region and the lower region.

2. The synthetic resin bottle of claim 1, wherein the weight of the straight region is not less than 12 times and not more than 15 times the weight of the reduced pressure absorbing region.

3. The synthetic resin bottle of claim 1, further comprising a content medium container space configured to contain the content medium, the content medium container space having a capacity of not less than 500 ml and not more than 800 ml.

* * * * *